US010613468B2

(12) United States Patent
Ino

(10) Patent No.: US 10,613,468 B2
(45) Date of Patent: Apr. 7, 2020

(54) IMAGE FORMING APPARATUS

(71) Applicant: Oki Data Corporation, Tokyo (JP)

(72) Inventor: Shiro Ino, Tokyo (JP)

(73) Assignee: Oki Data Corporation, Tokyo (JP)

( * ) Notice: Subject to any disclaimer, the term of this patent is extended or adjusted under 35 U.S.C. 154(b) by 0 days.

(21) Appl. No.: 16/417,548

(22) Filed: May 20, 2019

(65) Prior Publication Data

US 2020/0004197 A1 Jan. 2, 2020

(30) Foreign Application Priority Data

Jun. 27, 2018 (JP) ..... 2018-121584

(51) Int. Cl.
*G03G 21/16* (2006.01)

(52) U.S. Cl.
CPC ..... *G03G 21/1633* (2013.01); *G03G 21/1647* (2013.01); *G03G 21/1666* (2013.01); *G03G 21/1671* (2013.01)

(58) Field of Classification Search
CPC ..... G03G 21/1623; G03G 21/1633; G03G 21/1666; G03G 21/1671
See application file for complete search history.

(56) References Cited

U.S. PATENT DOCUMENTS 7,853,176 B2 * 12/2010 Itabashi ..... G03G 21/1817 399/114

FOREIGN PATENT DOCUMENTS

JP 2007-065125 A 3/2007

* cited by examiner

*Primary Examiner* — Erika J Villaluna
(74) *Attorney, Agent, or Firm* — Muncy, Geissler, Olds & Lowe, P.C.

(57) ABSTRACT

An image forming apparatus includes an apparatus main body having a rotation supporting point, a first rotating member rotatably supported by the rotation supporting point, a second rotating member arranged between the apparatus main body and the first rotating member and rotatably supported by the rotation supporting point, a photosensitive unit holding member holding a photosensitive unit and slidably supported by the second rotating member, a first engagement part that engages with the photosensitive unit holding member, and a second engagement part that engages with the apparatus main body.

When the first rotating member and the photosensitive unit holding member are engaged by the first engagement part, and engagement between the photosensitive unit holding member and the apparatus main body is released, the first rotating member integrally rotates with the second rotating member to open the opening, and when engagement between the first rotating member and the photosensitive unit holding member is released and the photosensitive unit holding member and the apparatus main body are engaged by the second engagement part, the first rotating member rotates to separate the exposure device from the photosensitive unit.

8 Claims, 13 Drawing Sheets

IMAGE FORMING APPARATUS

TECHNICAL FIELD

The present invention relates to an image forming apparatus having an openable and closeable upper cover.

BACKGROUND

In a conventional image forming apparatus, an upper cover rotatable about one side of an upper portion of the apparatus is provided and an LED (Light Emitting Diode) head assembly having an LED head is arranged on an inner surface of the upper cover, and, inside the apparatus, a photosensitive unit formed by integrating a photosensitive drum, a charging part, a development part, and a toner cartridge is detachably arranged, and, in a state in which the upper cover is closed, a light emitting surface of the LED head is arranged at a position where the photosensitive drum can be exposed. Further, in a color printer as an image forming apparatus, in order to form an image using developers of a plurality of colors, a photosensitive unit and an LED head for each of the developers of the respective colors are arranged in a carrying direction of a recording medium in the apparatus main body or on the upper cover (for example, see Patent Document 1).

RELATED ART

Patent Document(s)

[Patent Doc. 1] JP Laid-Open Patent Application Publication 2007-565125

However, in the conventional technology, when performing a maintenance operation such as removal of a jammed medium or replacement of a photosensitive unit, it is necessary to rotate the upper cover as a rotating member to open an opening part and take out the photosensitive unit from the apparatus. In this case, a place for placing the taken out photosensitive unit is necessary. Further, due to presence of an obstacle above the apparatus, a rotation angle of the upper cover may be limited. In this case, there is a problem that the LED head as an exposure device protruding vertically downward from the upper cover comes into contact with the photosensitive unit and this hinders a smooth maintenance operation. The present invention is intended to solve such a problem, and is intended to allow a maintenance operation of an image forming apparatus to be smoothly performed.

SUMMARY

An image forming apparatus, disclosed in the application, provided with a photosensitive unit that has a photosensitive body and an exposure device that exposes the photosensitive body, includes an apparatus main body that has an opening on its surface, having a rotation supporting point; a first rotating member that holds the exposure device and is rotatably supported by the rotation supporting point of the apparatus main body such that the first rotating member opens or closes the opening of the apparatus main body by swinging around the rotation supporting point; a second rotating member that is arranged between the apparatus main body and the first rotating member and is rotatably supported by the rotation supporting point of the apparatus main body; a photosensitive unit holding member that holds the photosensitive unit and is slidably supported by the second rotating member; a first engagement part that is provided in the first rotating member and engages with the photosensitive unit holding member; and a second engagement part that is provided in the photosensitive unit holding member and engages with the apparatus main body. Wherein when the first rotating member and the photosensitive unit holding member are engaged with each other by the first engagement part, and engagement between the photosensitive unit holding member and the apparatus main body is released by the second engagement part, the first rotating member integrally rotates with the second rotating member to open the opening and to separate the photosensitive unit from the apparatus main body, and when engagement between the first rotating member and the photosensitive unit holding member is released by the first engagement part and the photosensitive unit holding member and the apparatus main body are engaged with each other by the second engagement part, the first rotating member rotates to separate the exposure device from the photosensitive unit.

According to the present invention so accomplished, an effect can be achieved that a maintenance operation of an image forming apparatus can be smoothly performed.

BRIEF DESCRIPTION OF IRE DRAWINGS

DETAILED DESCRIPTION OF PREFERRED EMBODIMENT(S)

In the following, an embodiment of an image forming apparatus of the present invention is described with reference to the drawings.

Figure 1:
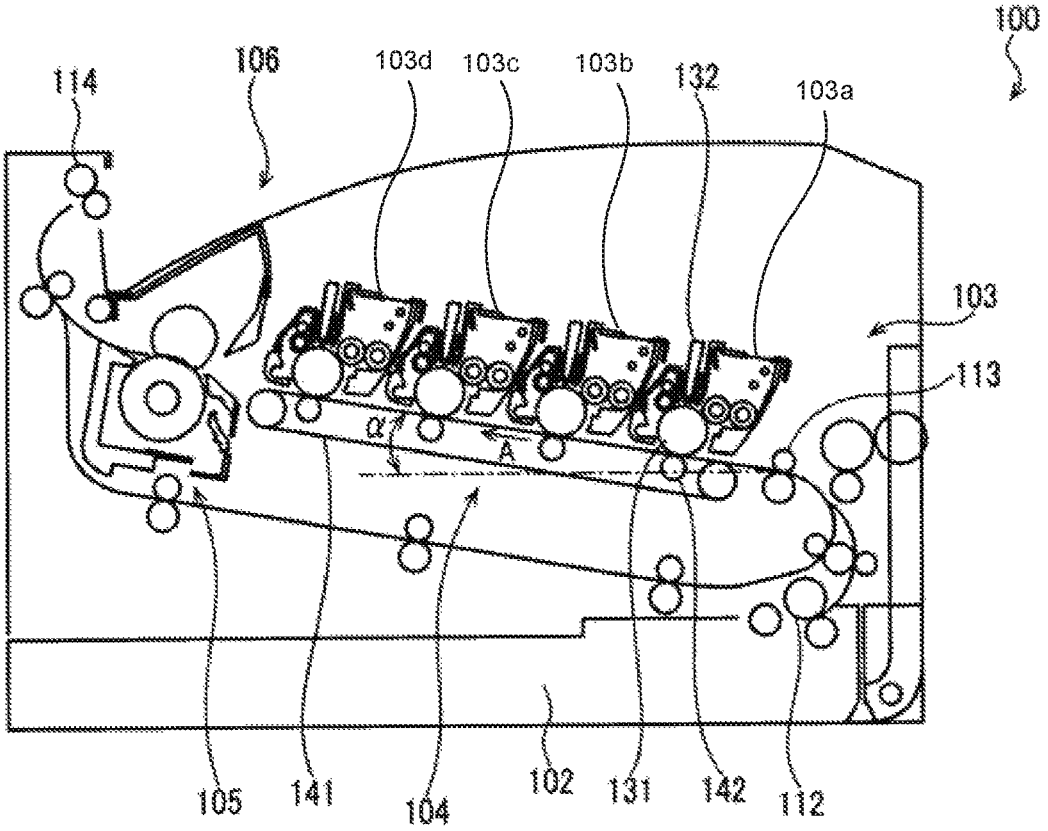
FIG. 1 is a schematic cross-sectional side view illustrating a configuration of an image forming apparatus of an embodiment.

FIG. 1 is a schematic cross-sectional side view illustrating a configuration of an image forming apparatus of the embodiment. In FIG. 1, an image forming apparatus 100 is, for example, an electrophotographic color printer, and performs printing by forming an image on a medium. In FIG. 1, a right side is a front side of the image forming apparatus 100, and a left side is a rear side of the image forming apparatus 100.

The image forming apparatus 100 has a sheet feeding cassette 102, ID units 103, LED (Light Emitting Diode) heads 132, a transfer unit 104, a fuser 105, and a medium stacking part 106.

The sheet feeding cassette 102 stacks and accommodates mediums. The mediums accommodated in the sheet feeding cassette 102 are separated and fed out one by one by rotation of a sheet feeding sub-roller, and each medium is further carried by a sheet feeding roller 112 in a medium carrying direction indicated by an arrow A in the drawing, and is carried toward a registration part 113.

The registration part 113 is arranged on a downstream side of the sheet feeding roller 112 in the medium carrying direction and includes, for example, a registration roller pair. The registration part 113 corrects a skew of a leading edge of the medium carried by the sheet feeding roller 112 and carries the medium to the transfer unit 104.

In the invention, the front side may be determined with an arrangement of ID units 103 and the medium carrying direction. There are four ID units 103 arranged from right to left in FIG. 1 (103*a* to 103*d* from right to left in FIG. 1). The rightmost ID unit 103*a* is at an upstream side with respect to medium carrying direction A. The leftmost ID unit 103*d* is at a downstream side with respect to the direction. Assuming that the image forming apparatus has a rectangle shape, which is formed with four sides, in the top view, one of the four sides that is the closest to the ID unit 103*a* may be defined as the front side. Another of the sides that is the closest to the ID unit 103*d* may be defined as the rear side. In another way, one of the four sides toward which ID units is pulled out may be defined as the front side of the invention.

When the image forming apparatus is designed to place on a ground, which is horizontal, a side that is expect to contact the ground is defined as the bottom side. An opposite side from the bottom side in the vertical direction is defined as the top side. In a case where the image forming apparatus is designed to be placed in an upright position, one side from which a printed medium exits may be defined as the top.

The ID units 103 as photosensitive units are each formed by integrating a photosensitive drum 131 as an image carrier, a charging roller as a charging part, a development roller as a development part, a toner cartridge accommodating a toner as a developer, and the like. The ID units 103 respectively include the photosensitive drums 131 as rotatable image carriers, and respectively form electrostatic latent images by selectively exposing the photosensitive drums 131 with the LED heads 132 according to image data, and respectively form toner images (developer images) as visible images by supplying respective toners to the electrostatic latent images.

Four ID (image drum) units 103 are arranged on a downstream side of the registration part 113 in the medium carrying direction, and respectively form toner images of respective colors on the photosensitive drums 131.

The LED heads 132 as exposure devices are respectively arranged opposing the photosensitive drums 131 of the ID units 103 and respectively expose the photosensitive drums 131. The LED heads 132 are rotatably provided on an upper cover of the image forming apparatus 100 (to be described later).

The transfer unit 104 has a transfer belt 141 and transfer rollers 142, and is arranged opposing the ID units 103. The transfer belt 141 is arranged opposing the photosensitive drums 131 of the ID units 103, and carries the medium carried from the registration part 113 toward the fuser 105 by rotating.

The transfer rollers 142 are respectively arranged opposing the photosensitive drums 131 of the ID units 103 via the transfer belt 141, and respectively transfer the toner images formed on the photosensitive drums 131 to the medium by applying transfer voltages.

In the present embodiment, the four ID units 103, and the transfer unit 104 arranged opposing the ID units 103, are arranged maintaining a predetermined inclination angle $\alpha$ with respect to a bottom of the image forming apparatus 100 so as to be inclined obliquely upward from an upstream side toward a downstream side in the medium carrying direction (from the front side toward the rear side of the image forming apparatus 100).

The fuser 105 is arranged on a downstream side of the transfer unit 104 in the medium carrying direction, and fuses the toner image transferred to the medium by applying heat and pressure thereto. The medium stacking part 106 is a stacker that stacks mediums ejected by an ejection roller part 114.

The so-configured image forming apparatus 100 performs printing by causing the sheet feeding roller 112 and the registration part 113 to carry the medium accommodated in the sheet feeding cassette 102 to the transfer unit 104, causing the transfer rollers 142 to respectively transfer the toner images formed on the photosensitive drums 131 of the ID units 103 to the medium, and further causing the fuser 105 to fuse the toner images transferred to the medium and ejecting the medium to the medium stacking part 106.

Further, in the image forming apparatus 100, the medium carrying path formed by the registration part 113 and the transfer belt 141 is formed to be inclined obliquely upward from an upstream side toward a downstream side in the medium carrying direction so as to form the predetermined inclination angle $\alpha$.

Figure 2:
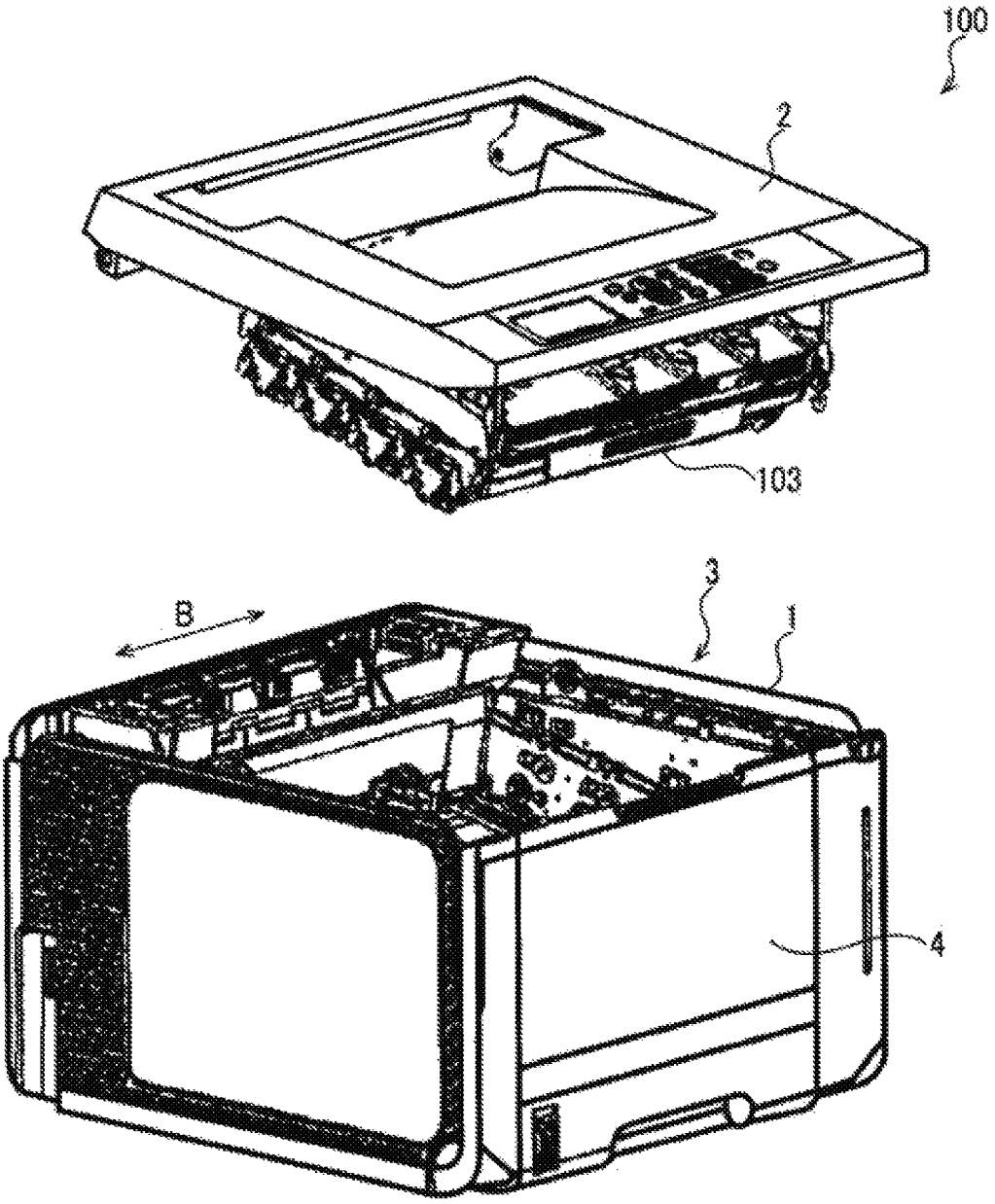
FIG. 2 is a perspective view illustrating configurations of an image forming apparatus main body and an upper cover of the embodiment.

FIG. 2 is a perspective view illustrating configurations of an image forming apparatus main body and an upper cover of the embodiment. In FIG. 2, the image forming apparatus 100 has an apparatus main body 1, an upper cover 2, and a front cover 4.

Inside the apparatus main body 1, a space for accommodating the LED heads 132 (see FIG. 1) and the ID units 103 (see FIG. 1) each formed by integrating a photosensitive drum, a charging part, a development part and a toner cartridge is provided. Further, an opening 3 is formed in an upper part of the apparatus main body 1, and a rotation shaft (rotation shaft 1*a* illustrated in FIG. 16) as a rotation supporting point rotatably supporting the upper cover 2 (an opening and closing cover 20 and a guide rail 40 illustrated in FIG. 3) is provided on one side of the upper part of the apparatus main body 1.

The upper cover 2 opens or closes the opening 3 formed on an upper side of the apparatus main body 1, and is rotatably supported by the rotation shaft provided on the one side of the upper part of the apparatus main body 1. The upper cover 2 opens or closes the opening 3 formed on the upper side of the apparatus main body 1 by rotating about the rotation shaft extending in a rotation shaft direction indicated by an arrow B in the drawing.

The front cover 4 as a front door is provided on a free end side (front side) of the upper cover 2, and opens or closes an opening that is formed on a front side of the apparatus main body 1 and is connected to the opening 3 by rotating about a rotation shaft extending in the rotation shaft direction indicated by the arrow B in the drawing. Therefore, by rotating the front cover 4 to open the front side opening and further rotating the upper cover 2, the front side and the upper side of the apparatus main body 1 are open, and a maintenance operation inside the image forming apparatus 100 by an operator can be easily performed.

Figure 3:
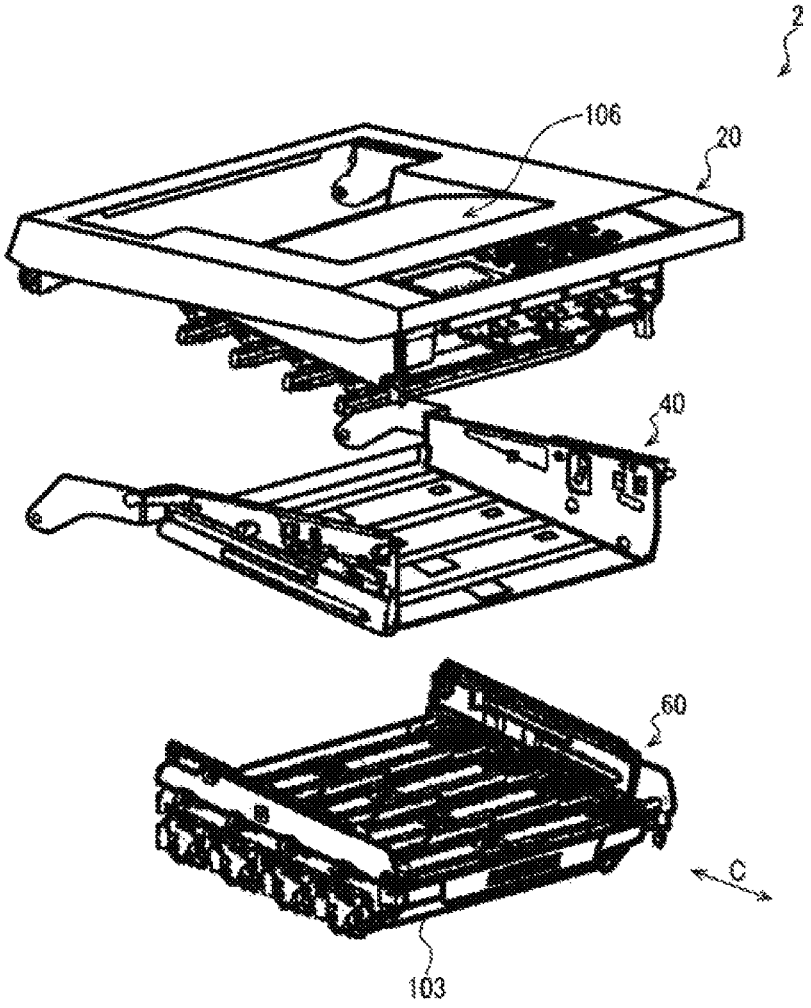
FIG. 3 is an exploded perspective view illustrating the configuration of the upper cover of the embodiment.

FIG. 3 is an exploded perspective view illustrating the configuration of the upper cover of the embodiment. In FIG. 3, the upper cover 2 as a cover includes the opening and closing cover 20, the guide rail 40, and a basket 60.

The opening and closing cover 20 as a first rotating member forms an upper part of the image forming apparatus 100 illustrated in FIG. 2, and holds the LED heads 132 illustrated in FIG. 1 and is rotatably supported by the rotation supporting point (the rotation shaft 1*a* illustrated in FIG. 16) of the apparatus main body 1 illustrated in FIG. 2, and opens or closes the opening 3 of the apparatus main body 1. Further, the medium stacking part 106 is formed on an upper surface of the opening and closing cover 20.

The guide rail 40 as a second rotating member is arranged between the apparatus main body 1 and the opening and closing cover 20 illustrated in FIG. 2, and is rotatably supported by the rotation supporting point (the rotation shaft 1*a* illustrated in FIG. 16) of the apparatus main body 1. The guide rail 40 is configured to be rotatable independently of the opening and closing cover 20.

The basket 60 as a photosensitive unit holding member holds the ID units 103 and is slidably supported by the guide rail 40. The basket 60 is supported by the guide rail 40 so as to be slidable in a sliding direction indicated by an arrow C in FIG. 3 which is orthogonal to the rotation shaft direction indicated by the arrow B in FIG. 2. Therefore, the basket 60 can rotate together with the guide rail 40.

Further, the basket 60 is configured to be engageable with the apparatus main body 1 illustrated in FIG. 2. By engaging the basket 60 with the apparatus main body 1, the rotation of the guide rail 40 is regulated, and further, by releasing the engagement of the basket 60 with the apparatus main body 1, the regulation of the rotation of the guide rail 40 is released.

Further, the basket 60 is configured to be engageable with the opening and closing cover 20. By engaging the basket 60 with the opening and closing cover 20 and releasing the engagement of the basket 60 with the apparatus main body 1, the basket 60 becomes rotatable relative to the apparatus main body 1 together with the opening and closing cover 20 and the guide rail 40. Further, by releasing the engagement of the basket 60 with the opening and closing cover 20 and engaging the basket 60 with the apparatus main body 1, the independent rotation of the opening and closing cover 20 is enabled and the rotation of the guide rail 40 relative to the apparatus main body 1 is regulated.

Figure 4:
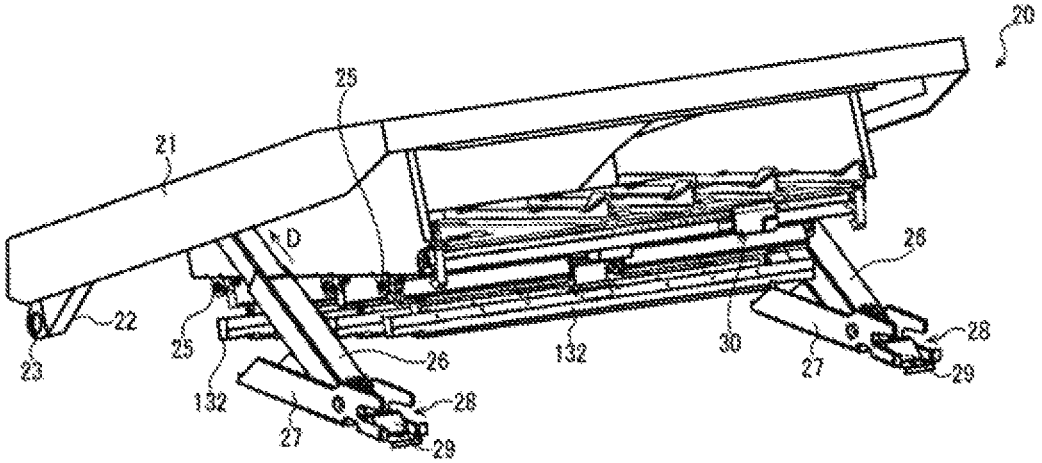
FIG. 4 is a perspective view of an opening and closing cover of the embodiment.
Figure 5A:
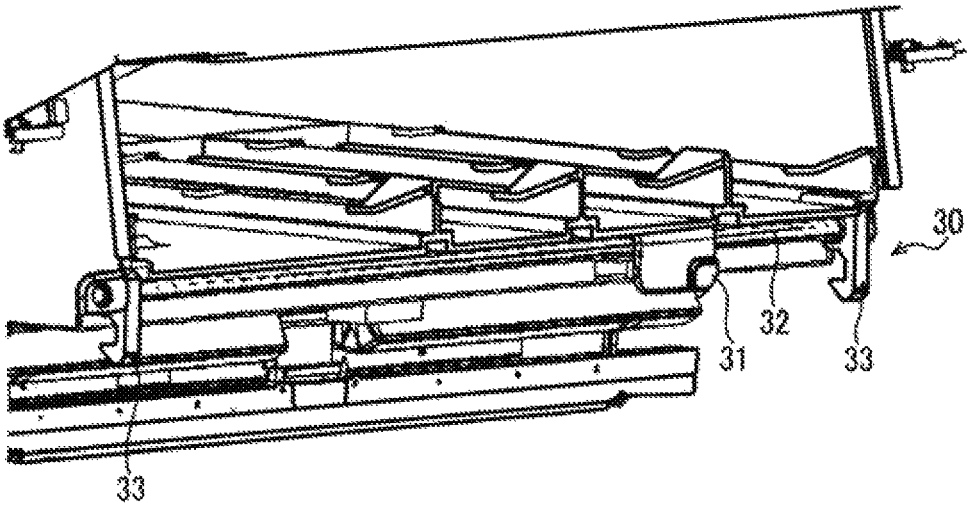
FIGS. 5A and 5B are explanatory diagrams of the opening and closing cover of the embodiment.
Figure 5B:
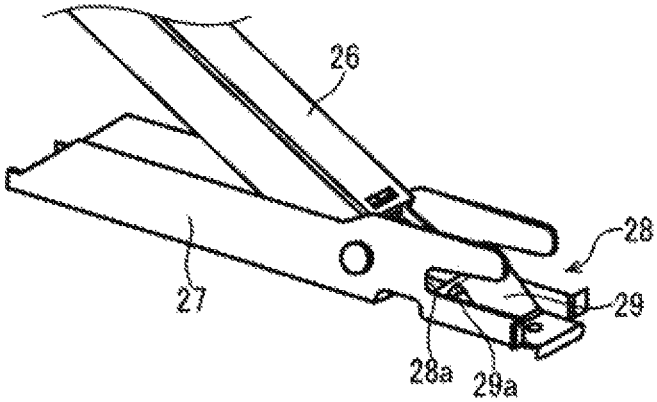

FIG. 4 is a perspective view of the opening and closing cover of the embodiment. FIGS. 5A and 5B are explanatory diagrams of the opening and closing cover of the embodiment. In FIG. 4, the opening and closing cover 20 has an exterior cover 21, an inner plate 22, rotation shaft bearings 23, the LED heads 132, rotation shaft bearings 25, support parts 26, brackets 27, and a lock part 30. The exterior cover 21 forms an exterior of an upper portion of the image forming apparatus 100 illustrated in FIG. 2.

The inner plate 22 as an inner support is a member that forms an inner part and an inner surface of the exterior cover 21 and supports the exterior cover 21. The rotation shaft bearings 23 are each formed at an end part of the inner plate 22, and the inner plate 22 is rotatable about the rotation shaft bearings 23. The rotation shaft bearings 23 are parts supported by the rotation shaft provided in the apparatus main body 1 illustrated in FIG. 2, and rotatably support the inner plate 22 and the exterior cover 21. The rotation shaft bearings 23 are respectively provided at both end parts of the opening and closing cover 20 in the rotation shaft direction.

The LED heads 132 are exposure devices respectively exposing the photosensitive drums of the ID units, and are rotatably supported by the rotation shaft bearings 25 of the inner plate 22. The rotation shaft bearings 25 are provided on the inner plate 22 and rotatably support the LED heads 132.

The support parts 26 support the rotatable inner plate 22 and exterior cover 21. One end part of each of the support parts 26 is rotatably supported by the inner plate 22, and the other end part of each of the support parts 26 is rotatably supported by one of the brackets 27. Each of the support parts 26 is configured to be extendable and contractible by having two members that can slide relative to each other, and is biased in an extension direction indicated by an arrow D in the drawing by a biasing member such as a spring provided therein. Therefore, the inner plate 22 and the exterior cover 21 are supported by the support parts 26 by being biased so as to be pushed up from the apparatus main body 1 illustrated in FIG. 2.

The brackets 27 as fixed parts respectively rotatably support the support parts 26 and are fixed to the apparatus main body 1 illustrated in FIG. 2, Therefore, the exterior cover 21 is biased in an opening direction with respect to the apparatus main body 1. Further, as illustrated in FIG. 5B, a groove 28 and a leaf spring 29 as holding parts holding the guide rail 40 are arranged on an end part of each of the brackets 27 (an end part on an opposite side with respect to the rotation shaft bearings 23).

Figure 6:
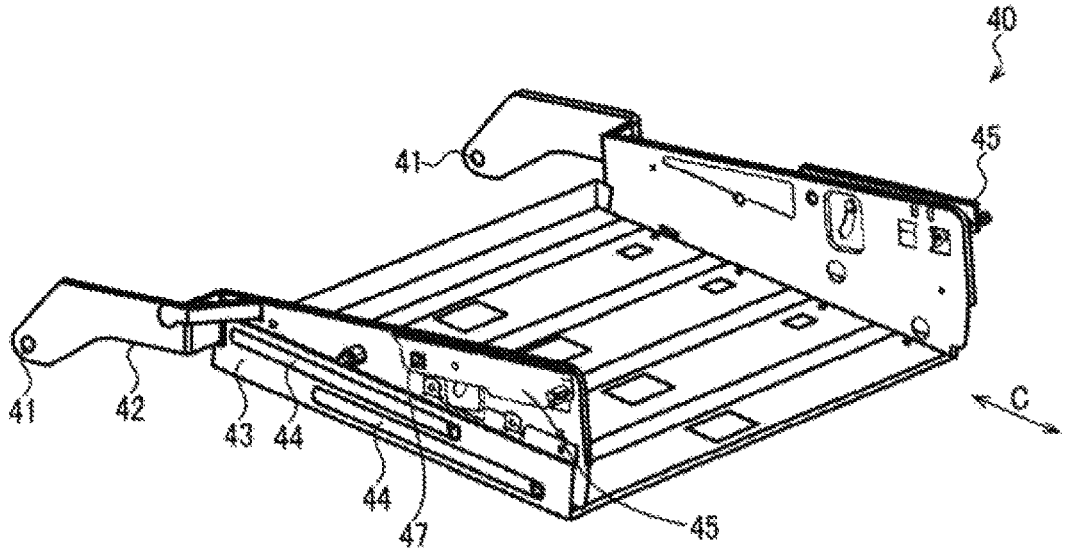
FIG. 6 is a perspective view of a guide rail of the embodiment.

The grooves 28 as guide grooves are grooves each formed in a U shape, and respectively engage with posts 50 of support members 45 of the guide rail 40 illustrated in FIG. 6 and respectively slidably guide the posts 50.

The leaf springs 29 as sliding regulating members are bent so as to respectively protrude into the grooves 28 which respectively slidably guide the posts 50 of the guide rail 40. The leaf springs 29 respectively regulate the sliding of the posts 50 entered into the grooves 28 by pressing the posts 50 against wall parts (inner parts) 28*a* of the grooves 28 with bent protruding parts 29*a*.

The lock part 30 as a first engagement part engages with the basket 60 supported by the guide rail 40 illustrated in FIG. 3. By engaging the lock part 30 with the basket 60, the basket 60 and the guide rail 40 can be rotated together with the opening and closing cover 20, and, by releasing the engagement of the lock part 30 with the basket 60, the opening and closing cover 20 can be rotated independently of the guide rail 40 and the basket 60.

As illustrated in FIG. 5A, the lock part 30 has a handle part 31, a handle shaft 32, and hooks 33. The handle part 31 is attached to the handle shaft 32 which is rotatably supported on a free end side of the opening and closing cover 20. Further, the hooks 33 are respectively attached to left and right end parts of the handle shaft 32 and engage with the basket 60 supported by the guide rail 40 illustrated in FIG. 3.

Therefore, the engagement with the basket 60 can be released by operating the handle part 31 to rotate the hooks 33 engaged with the basket 60. Further, the hooks 33 can be engaged with the basket 60 by rotating the opening and closing cover 20 in a closing direction with respect to the apparatus main body 1.

Figure 7:
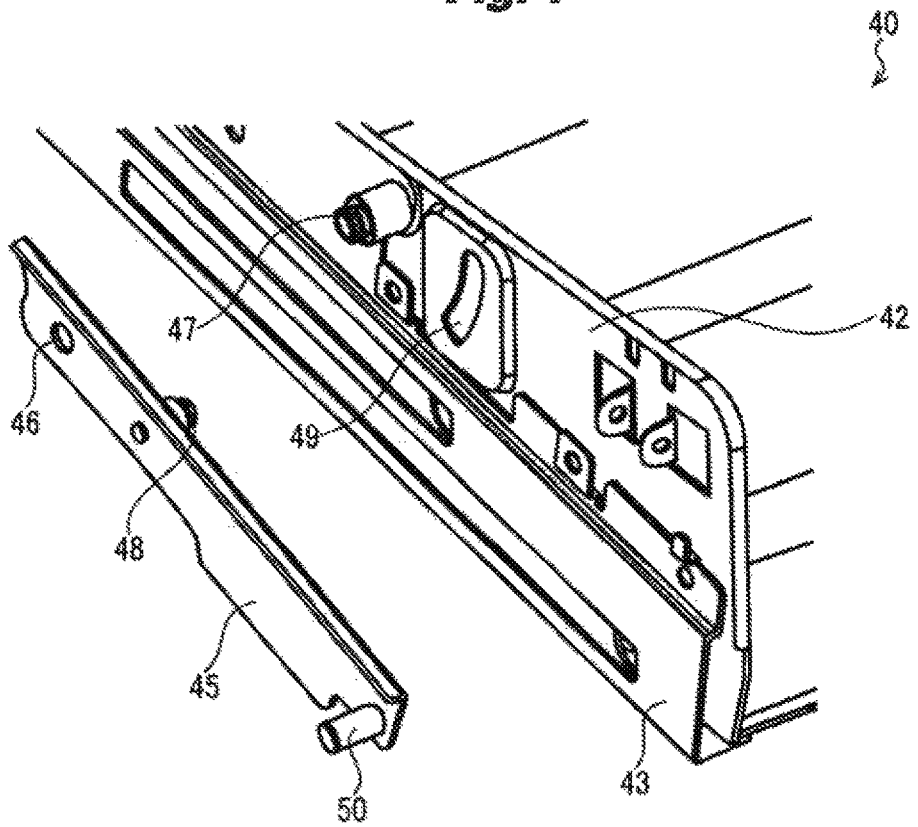
FIG. 7 is an explanatory diagram of the guide rail of the embodiment.

FIG. 6 is a perspective view of the guide rail of the embodiment. FIG. 7 is an explanatory diagram of the guide rail of the embodiment. In FIG. 6, the guide rail 40 has rotation shaft bearings 41, guide rail bases 42, rail plates 43, elongated holes 44, and the support members 45, and slidably supports the basket 60 illustrated in FIG. 3.

The rotation shaft bearings 41 are parts supported by the rotation shaft that is provided in the apparatus main body 1 illustrated in FIG. 2 and supports the opening and closing cover 20 illustrated in FIG. 3. The rotation shaft bearings 41 rotatably support the guide rail 40. The rotation shaft bearings 41 are respectively provided at both end parts of the guide rail 40 in the rotation shaft direction.

The guide rail bases 42 as bases are members that form a frame of the guide rail 40, and are members that rotatably support the entire guide rail 40. The rotation shaft bearings 41 are respectively formed on front end parts of the guide rail bases 42 on one side. The rail plates 43 are members that are respectively provided on both left and right sides of the guide rail 40 in the direction (sliding direction) indicated by the arrow C in the drawing which is orthogonal to the rotation shaft direction and that each extend in the sliding direction which is orthogonal to the rotation shaft direction, and two elongated holes 44 are formed in each of the rail plates 43.

The elongated holes 44 are formed in the respective rail plates 43 so as to each extend in the sliding direction which is orthogonal to the rotation shaft direction, and engage with the basket 60 illustrated in FIG. 3 so as to support the basket 60 and allow the basket 60 to be slidable in the sliding direction. The support members 45 are members that are provided so as to be respectively rotatably supported on both left and right sides of the guide rail 40 in the sliding direction and on outer sides of the guide rail bases 42, and respectively support the guide rail bases 42 with respect to the apparatus main body 1 illustrated in FIG. 2.

The support members 45 as rotation regulating parts regulate the rotation of the guide rail 40, and, as illustrated in FIG. 7, each have a rotation shaft bearing 46, a guide post 48, and a post 50. The rotation shaft bearings 46 are respectively provided on end sides of the support members 45 on one side, and respectively engage with rotation shafts 47 that are respectively provided on the guide rail bases 42 on the left and right sides of the guide rail 40 in the sliding direction, and allow the support members 45 to be rotatable relative to the guide rail bases 42.

The guide posts 48 are protruding parts that respectively protrude to the guide rail base 42 sides, and can respectively engage with guide grooves 49 that are respectively formed in the guide rail bases 42. The guide grooves 49 are each formed in an arc shape, and respectively regulate rotation angles of the support members 45 that respectively rotate about the rotation shaft bearings 46. Therefore, the support members 45 are rotatable within a range in which the guide posts 48 can respectively move inside the guide grooves 49.

The posts 50 are protruding parts that are respectively formed on free-end side end parts of the support members 45 on opposite sides with respect to the rotation shaft bearings 46, and respectively protrude to opposite sides with respect to the guide rail bases 42. When the guide rail bases 42 of the guide rail 40 rotate about the rotation shaft bearings 41, the posts 50 respectively engage with the grooves 28 of the opening and closing cover 20 illustrated in FIG. 4 and FIG. 5B, and are further respectively pressed against the wall parts 28*a* of the grooves 28 by the leaf springs 29 and held so as not to come out of the grooves 28, and the sliding of the posts 50 are regulated.

In this way, by regulating the sliding of the posts 50, the rotation of the guide rail 40 is regulated, and a position of the guide rail 40 in the rotation direction relative to the apparatus main body 1 is maintained.

Figure 8:
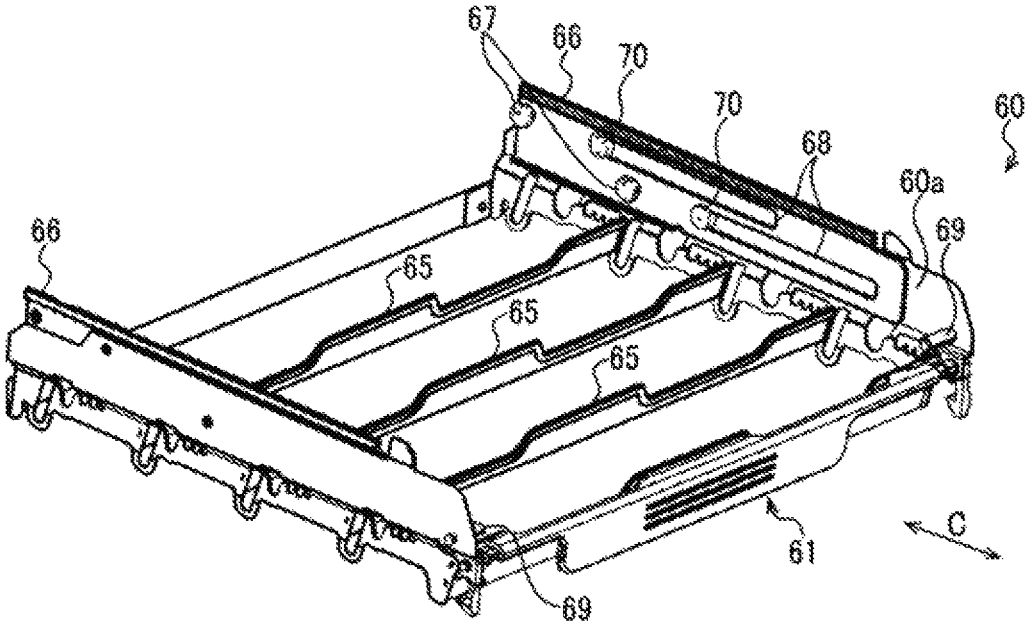
FIG. 8 is a perspective view of a basket of the embodiment.
Figure 9:
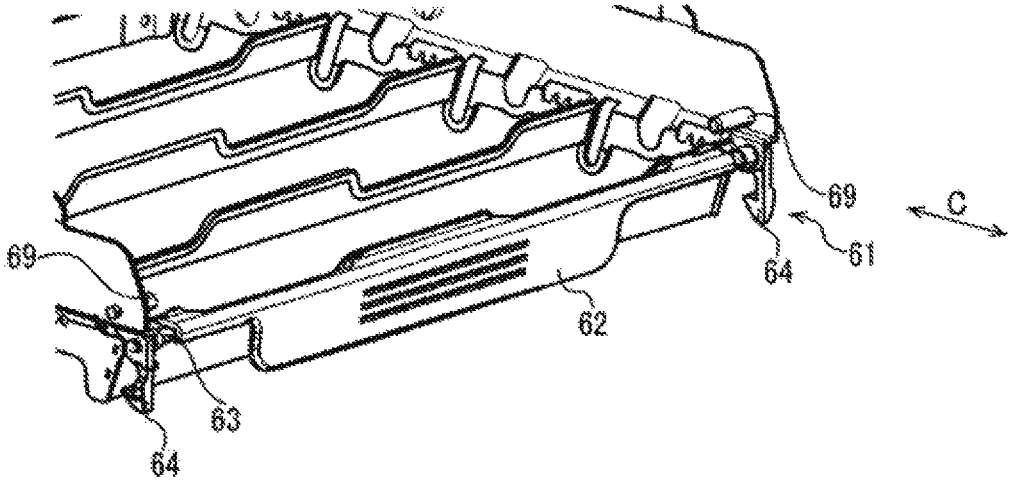
FIG. 9 is an explanatory diagram of the basket of the embodiment.
Figure 10:
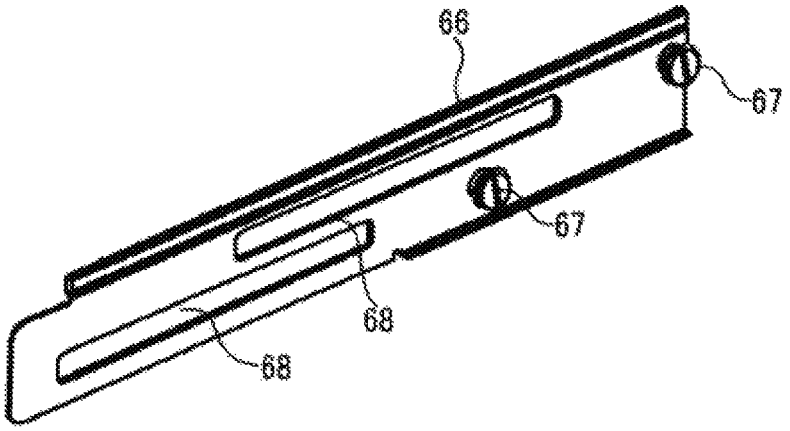
FIG. 10 is an explanatory diagram of the basket of the embodiment.

FIG. 8 is a perspective view of the basket of the embodiment. FIGS. 9 and 10 are explanatory diagrams of the basket of the embodiment. In FIG. 8, the basket 60 has a lock part 61, partition plates 65, rail plates 66, and lock posts 69.

The lock part 61 as a second engagement part engages with the apparatus main body 1 illustrated in FIG. 2 and, as illustrated in FIG. 9, has a handle part 62 for unlocking, and a handle shaft 63.

The handle part 62 is attached to the handle shaft 63 which is arranged substantially parallel to the rotation shaft direction indicated by the arrow B in FIG. 2, and rotates together with the handle shaft 63. The handle shaft 63 is rotatably supported on a front side of the basket 60 and has hooks 64 respectively attached to both end parts thereof. Therefore, by operating the handle part 62, the hooks 64 can be rotated.

The hooks 64 of the lock part 61 respectively engage with lock posts provided in the apparatus main body 1 illustrated in FIG. 2 to maintain a state in which the apparatus main body 1 and the basket 60 are integrated. Further, when the engagement of the hooks 64 with the lock posts provided in the apparatus main body 1 is released, the basket 60 can be separated (rotated) from the apparatus main body 1.

The plurality of partition plates 65 are arranged in the sliding direction indicated by the arrow C in the drawings (the front-rear direction of the image forming apparatus 100 in FIGS. 1 and 2), and the ID units of the respective colors are respectively accommodated between adjacent partition plates 65.

The rail plates 66 are respectively arranged on left and right side edges of the basket 6C) in the sliding direction, and, as illustrated in FIG. 10, two posts 67 and two elongated holes 68 are provided on an inner side of each of the rail plates 66.

The posts 67 respectively engage with the elongated holes 44 of the guide rail 40 illustrated in FIG. 6. The posts 67 are slidable within the ranges of the engaging elongated holes 44. Therefore, the rail plates 66 are slidably supported by the guide rail 40.

The elongated holes 68 are formed in the rail plates 66 so as to each extend in the sliding direction indicated by the arrow C in FIG. 8, and respectively engage with posts 70 that are respectively formed on left and right side end surfaces 60*a* of the basket 60 in the sliding direction. By respectively engaging the elongated holes 68 with the posts 70 of the basket 60, the rail plates 66 can slide within the ranges of the elongated holes 68 relative to the basket 60. Therefore, the basket 60 is slidably supported on the guide rail 40 illustrated in FIG. 6 via the rail plates 66.

The lock posts 69 are respectively formed on the left and right side end surfaces 60*a* of the basket 60 in the sliding direction, and respectively engage with the hooks 33 of the lock part 30 of the opening and closing cover 20 illustrated in FIGS. 4 and 5. By engaging the lock posts 69 with the hooks 33 of the lock part 30 of the opening and closing cover 20, the opening and closing cover 20, the guide rail 40 and the basket 60 illustrated in FIGS. 3-9 are integrated.

An action of the above-described configuration is described below. An outline of a print operation of the image forming apparatus has been described above and thus a description about the print operation is omitted here. An action of the upper cover of the image forming apparatus is described below based on FIGS. 11-20.

Figure 11:
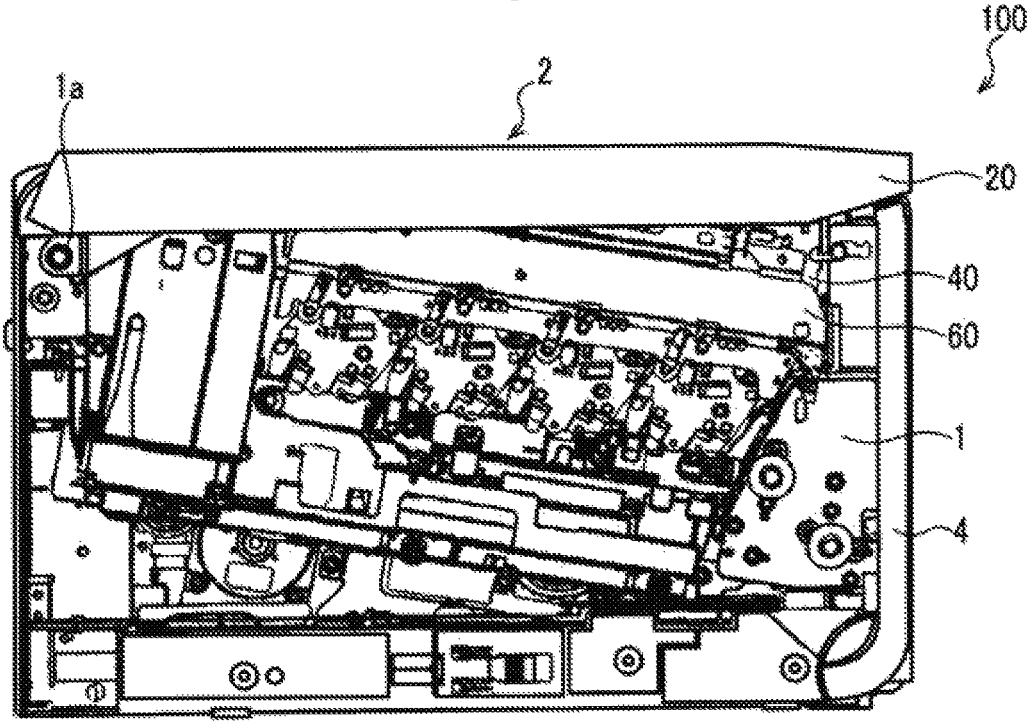
FIG. 11 is an explanatory diagram illustrating a closed state of the upper cover of the embodiment.

FIG. 11 is an explanatory diagram illustrating a closed state of the upper cover of the embodiment, and illustrates a first state in which the upper cover 2 illustrated in FIG. 2 closes the opening 3 of the image forming apparatus 100. As illustrated in FIG. 11, in the first state in which the upper cover 2 closes the opening of the image forming apparatus 100, the opening and closing cover 20 of the upper cover 2 engages with the apparatus main body to maintain a state in which the opening is closed, and the guide rail 40 and the basket 60 are accommodated inside the image forming apparatus 100.

In this case, a state is maintained in which the hooks 33 of the lock part 30 of the opening and closing cover 20 illustrated in FIGS. 4 and 5 respectively engage with the lock posts 69 of the basket 60 illustrated in FIGS. 8 and 9 so that the opening and closing cover 20, the guide rail 40 and the basket 60 are integrated, and further, the hooks 64 of the lock part 61 of the basket 60 respectively engage with the lock posts provided in the apparatus main body 1 so that the apparatus main body 1, the opening and closing cover 20, the guide rail 40 and the basket 60 are integrated.

Figure 12:
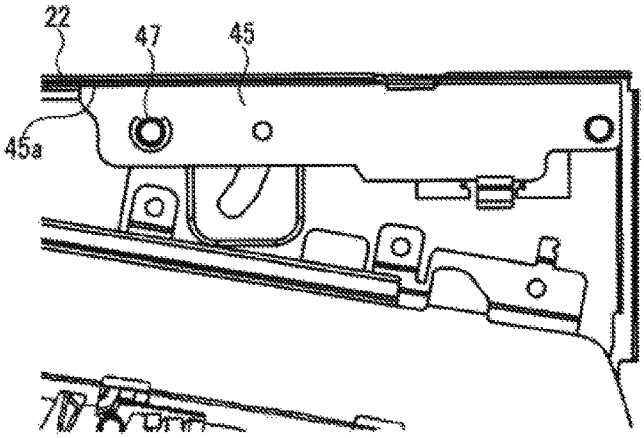
FIG. 12 is an explanatory diagram illustrating a support part in the closed state of the upper cover of the embodiment.

In the first state, as illustrated in FIG. 12, end parts 45*a* of the support members 45 of the guide rail 40 are in contact with the inner plate 22 of the opening and closing cover 20, and the rotation of the support members 45 about the rotation shaft 47 is regulated. That is, when the opening and closing cover 20 and the basket 60 are engaged with each other by the lock part 61, the end parts 45*a* of the support members 45 of the guide rail 40 are in contact with the inner plate 22 of the opening and closing cover 20, and the rotation of the support members 45 is regulated.

In the first state, in a state in which the front opening of the image forming apparatus 100 is closed by the front cover 4, a print operation of the image forming apparatus 100 is enabled.

Next, a second state is described in which, when medium jam or the like occurs in the medium carrying path and the medium is removed from the medium carrying path, the opening 3 is opened by integrally rotating the opening and closing cover 20, the guide rail 40 and the basket 60 which are illustrated in FIGS. 2 and 3.

Figure 13:
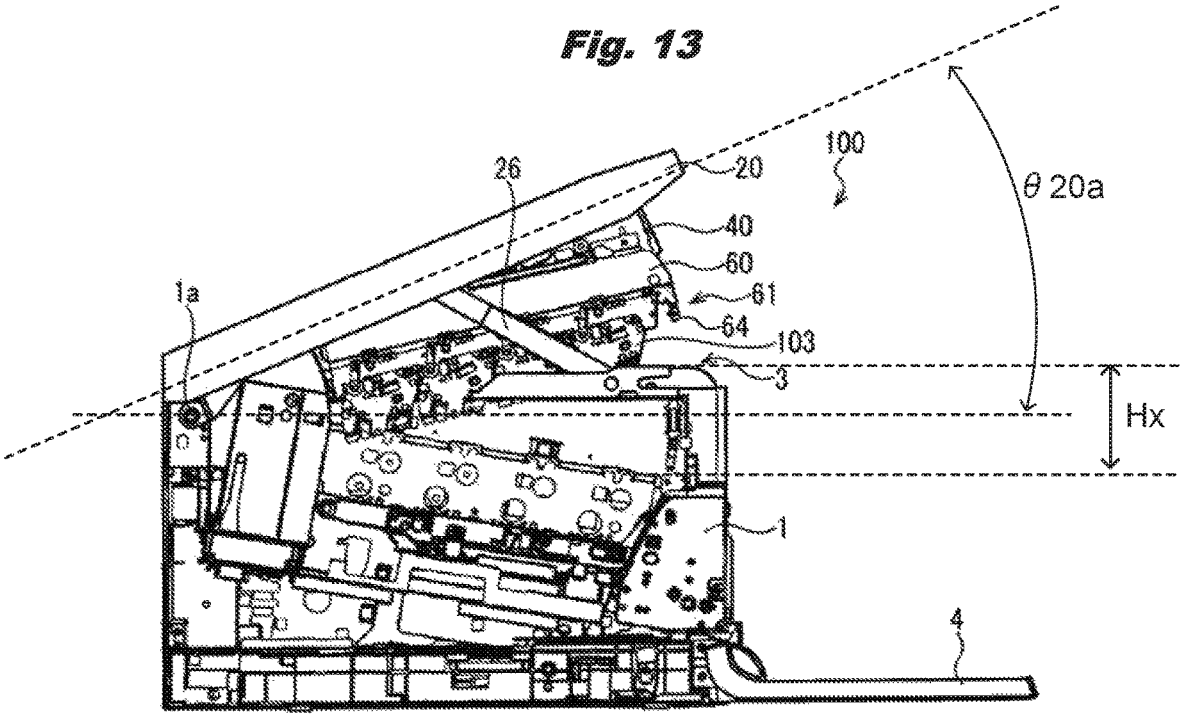
FIG. 13 is an explanatory diagram illustrating a rotated state of the upper cover of the embodiment.

FIG. 13 is an explanatory diagram illustrating a rotated state of the upper cover of the embodiment, and illustrates the second state in which the opening 3 is opened by integrally rotating the opening and closing cover 20, the guide rail 40 and the basket 60. As illustrated in FIG. 13, by rotating the front cover 4 to open the front side opening and operating the lock part 61 of the basket 60 (an operation in which the handle part 62 of the lock part 61 illustrated in FIG. 9 is rotated), the engagement between the hooks 64 and the apparatus main body 1 is released. When the engagement with the apparatus main body 1 is released, the opening and closing cover 20 is pushed upward by the biased support parts 26 and rotates together with the guide rail 40 and the basket 60 about the rotation shaft 1*a*, and the opening 3 is opened. In this case, the opening and closing cover 20 maintains a state of being pushed upward by the biasing force of the support parts 26. The angle of cover 20 around rotation shaft 1*a* is denoted with θ20*a*, which is with respect to the horizontal line. In the embodiment, angle θ20*a* is preferred to be 25 degrees or more In this case, the lock posts 69 of the basket 60 illustrated in FIGS. 8 and 9 are respectively engaged with the hooks 33 of the lock part 30 of the opening and closing cover 20 illustrated in FIGS. 4 and 5, and thus, the guide rail 40 and the basket 60 integrally rotate with the opening and closing cover 20.

In this way, when the opening and closing cover 20 and the basket 60 are engaged with each other by the lock part 30 and the engagement between the basket 60 and the apparatus main body 1 is released by the lock part 61, the opening and closing cover 20 integrally rotates with the guide rail 40 and the basket 60, and thus, the opening 3 of the apparatus main body 1 is opened and the ID units 103 are separated from the apparatus main body 1, and a space between the ID units 103 and the apparatus main body 1 is formed. A height of the space is denoted with Hx in FIG. 13. Height Hx is preferred to be 60 mm or more such that the empty space becomes large enough to let a user put its hand into the space, for example, to pull a jammed sheet out of image forming apparatus 100.

As a result, an operator can touch the medium carrying path inside the image forming apparatus 100 from the opened opening 3 and front side opening, and a jammed medium or the like can be easily removed from the medium carrying path.

Further, in the present embodiment, the medium carrying path is formed obliquely upward so as to form a predetermined inclination angle from an upstream side toward a downstream side in the medium carrying direction (from the front side toward the rear side of the image forming apparatus 100). Therefore, the medium carrying path inside the image forming apparatus 100 is easily visible from the opened opening 3 and front side opening, and an operator can easily perform a maintenance operation. Also in the second state, as illustrated in FIG. 12, the end parts 45*a* of the support members 45 of the guide rail 40 are in contact with the inner plate 22 of the opening and closing cover 20, and the rotation of the support members 45 about the rotation shaft 47 is regulated. The predetermined inclination angle, which is indicated with a in FIG. 1, is ranged from 5 to 10 degrees.

Further, when returning from the second state to the first state, the opening and closing cover 20 is pressed down to engage the basket 60 with the apparatus main body 1 by the lock part 61, and the front cover 4 is rotated to close the front side opening. Next, a third state is described in which, when cleaning of the LED heads or the like is performed, in a state in which the guide rail 40 and the basket 60 illustrated in FIGS. 2 and 3 are engaged with the apparatus main body 1, only the opening and closing cover 20 is rotated.

Figure 14:
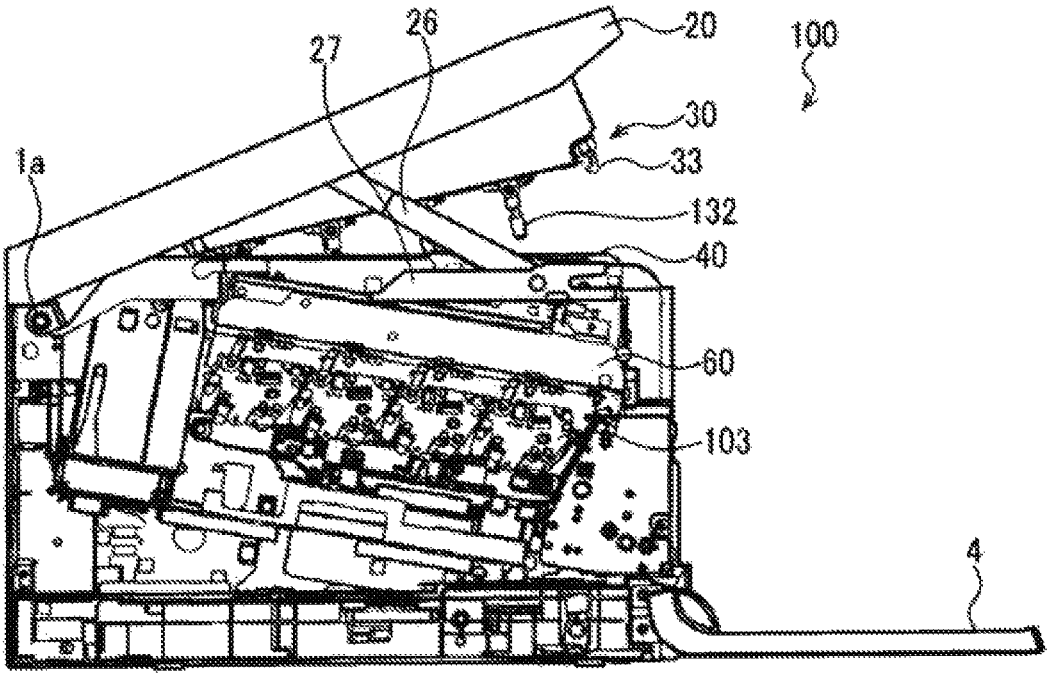
FIG. 14 is an explanatory diagram illustrating a rotated state of the opening and closing cover of the embodiment.

FIG. 14 is an explanatory diagram illustrating a rotated state of the opening and closing cover of the embodiment, and illustrates the third state in Which only the opening and closing cover 20 is rotated. As illustrated in FIG. 14, by rotating the front cover 4 to open the front side opening and operating the lock part 30 of the opening and closing cover 20 (an operation in which the handle part 31 of the lock part 30 illustrated in FIGS. 4 and 5 is rotated), the engagement between the hooks 33 and the lock posts 69 of the basket 60 is released. When the engagement with the basket 60 is released, the opening and closing cover 20 is pushed upward by the biased support parts 26 and rotates about the rotation shaft 1*a*. In this case, the opening and closing cover 20 maintains a state of being pushed upward by the biasing force of the support parts 26.

In this case, the lock posts 69 of the basket 60 illustrated in FIGS. 8 and 9 are not respectively engaged with the hooks 33 of the lock part 30 of the opening and closing cover 20 illustrated in FIGS. 4 and 5, and thus, the guide rail 40 and the basket 60 do not integrally rotate with the opening and closing cover 20. Further, the hooks 64 of the lock part 61 of the basket 60 are respectively engaged with the lock posts provided in the apparatus main body 1. Therefore, the guide rail 40 and the basket 60 are in a state of being engaged with the apparatus main body 1.

In this way, when the engagement between the opening and closing cover 20 and the basket 60 is released by the lock part 30 and the basket 60 and the apparatus main body 1 are engaged with each other by the lock part 61, only the opening and closing cover 20 rotates, and thus, the LED heads 132 are respectively separated from the ID units 103, and a space between the LED heads 132 and the ID units 103 is formed. As a result, an operator can visually confirm the LED heads 132 attached to the opening and closing cover 20 which has been rotated and can touch the LED heads 132, and can easily clean the LED heads 132 by rotating the LED heads 132.

Figure 15:
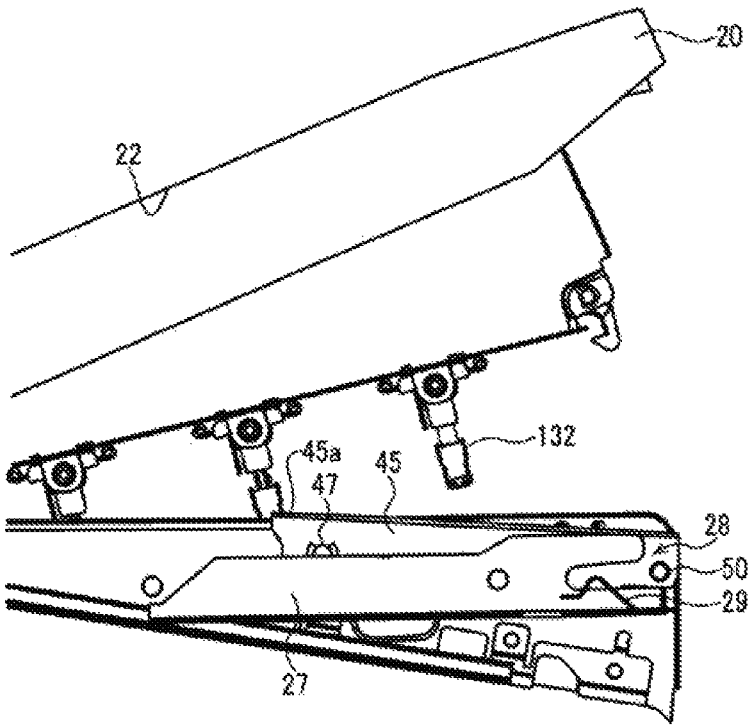
FIG. 15 is an explanatory diagram illustrating the support part in the rotated state of the opening and closing cover of the embodiment.

In the third state, as illustrated in FIG. 15, the end parts 45*a* of the support members 45 of the guide rail 40 are not in contact with the inner plate 22 of the opening and closing cover 20, and thus, the rotation of the support members 45 about the rotation shaft 47 is enabled. That is, when the engagement between the opening and closing cover 20 and the basket 60 is released by the lock part 30 and the opening and closing cover 20 rotates relative to the basket 60, the support members 45 of the guide rail 40 become rotatable.

Further, in the third state, the ID units 103 are in a state of being arranged along the medium carrying path which is inclined at a predetermined inclination angle (the inclination angle α illustrated in FIG. 1) in a direction approaching the rotation shaft 1*a*. When returning from the third state to the first state, the opening and closing cover 20 is pressed down to engage the opening and closing cover 20 with the basket 60 by the lock part 30, and the front cover 4 is rotated to close the front side opening.

Figure 16:
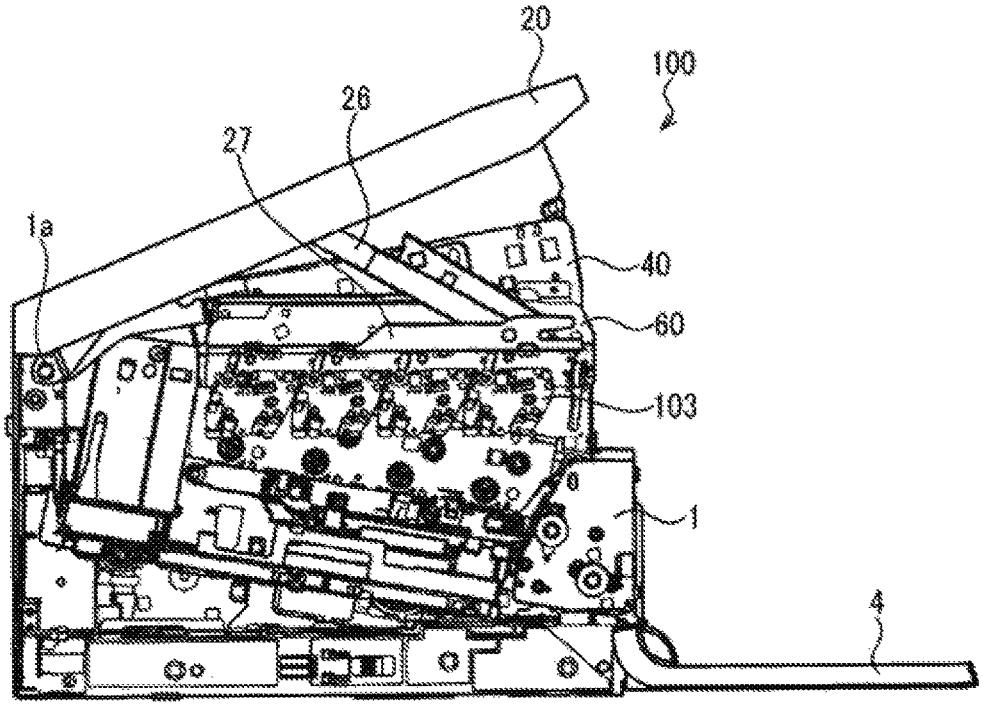
FIG. 16 is an explanatory diagram illustrating a rotated state of the opening and closing cover and the guide rail of the embodiment.

Next, with reference to FIGS. 16-20, a fourth state is described in which, when replacement of the ID units or the like is performed, the rotation of the basket 60 is enabled from the third state illustrated in FIG. 14. FIG. 16 is an explanatory diagram illustrating a rotated state of the opening and closing cover and the guide rail of the embodiment, and illustrates the fourth state in which the rotation of the basket 60 is enabled.

By rotating the handle part 62 of the lock part 61 of the basket 60 illustrated in FIG. 9 from the third state illustrated in FIG. 14 to release the engagement between the hooks 64 and the lock posts provided in the apparatus main body 1, the basket 60 and the guide rail 40 are pushed upward toward the opening and closing cover 20 which has already been rotated, and, as illustrated in FIG. 16, are rotated about the rotation shaft 1*a* to a position where the basket 60 is substantially horizontal and is slidable.

In this case, since the opening and closing cover 20 has already been rotated upward and is separated from the guide rail 40, the end parts 45*a* of the support members 45 of the guide rail 40 are not in contact with the inner plate 22 of the opening and closing cover 20, and thus, the support members 45 can freely rotate about the rotation shaft 47.

Figure 17:
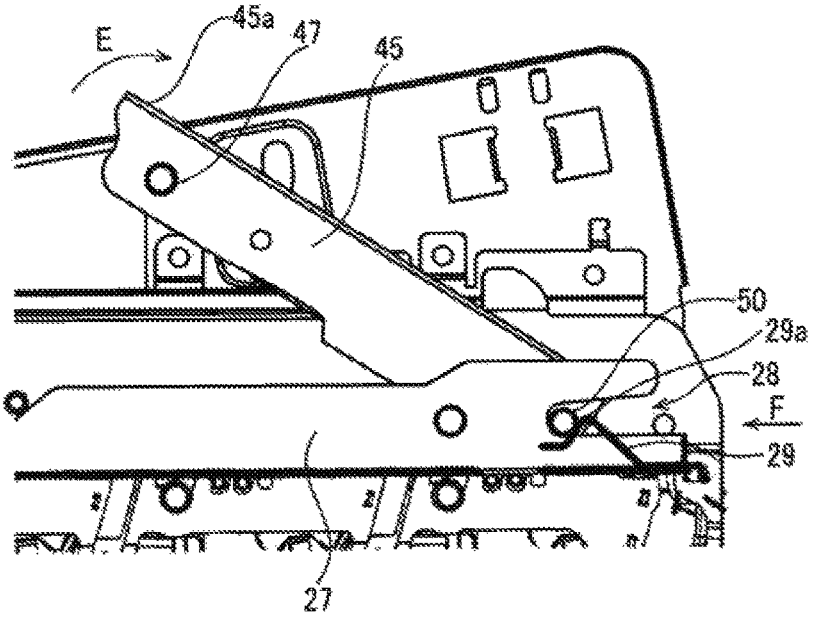
FIG. 17 is an explanatory diagram illustrating the support part in the rotated state of the opening and closing cover and the guide rail of the embodiment.

When the guide rail 40 is rotated, as illustrated in FIG. 17, along with the rotation of the guide rail 40, the support members 45 rotate about the rotation shaft 47 in a direction indicated by an arrow E in the drawing, and the posts 50 respectively provided on the free ends of the support members 45 are respectively guided by the grooves 28 of the brackets 27 fixed to the apparatus main body to move in a direction indicated by an arrow F in the drawing, press down the leaf springs 29, and move over the protruding parts 29*a* to become in contact with the wall parts 28*a* of the grooves 28, and thus, the rotation of the support members 45 is regulated.

That is, when the guide rail 40 is rotated to a predetermined position where the basket 60 is slidable, the posts 50 which are respectively provided on the free ends of the support members 45 respectively engage with the grooves 28 of the brackets 27 as engagement parts of the apparatus main body to regulate the rotation of the guide rail 40.

In this way, when the rotation of the support members 45 is regulated, the rotation of the guide rail 40 is also regulated, and the guide rail 40 is fixed with respect to the apparatus main body 1 at a position where the basket 60 is substantially horizontal.

In the present embodiment, when an angle by which the guide rail 40 has been rotated from the third state illustrated in FIG. 14 is substantially equal to the inclination angle α (see FIG. 1) at which the ID units 103 are arranged, the guide rail 40 is regulated in rotation by the support member 45 and is fixed at a predetermined position where the basket 60 is slidable. As noted above, it is one example that the rotation angle of guide rail 40 is set to be equal to inclination angle α, but it is not necessary to be exactly equal. It is practical to set the rotation angle to be ranged between −3 degrees and +3 degrees from the inclination angle. Further, in the light of sliding ID units 103 to the front side (or to the right direction in FIGS. 12-15), it may be preferred to set the rotation angle to be slightly smaller, which may be from 0.1 degrees to 0.5 degrees, than inclination angle α so that ID units 103 slightly inclines downward to the front side, making it easy to slide ID units 103 to ward the front side due to its own weight.

Figure 18:
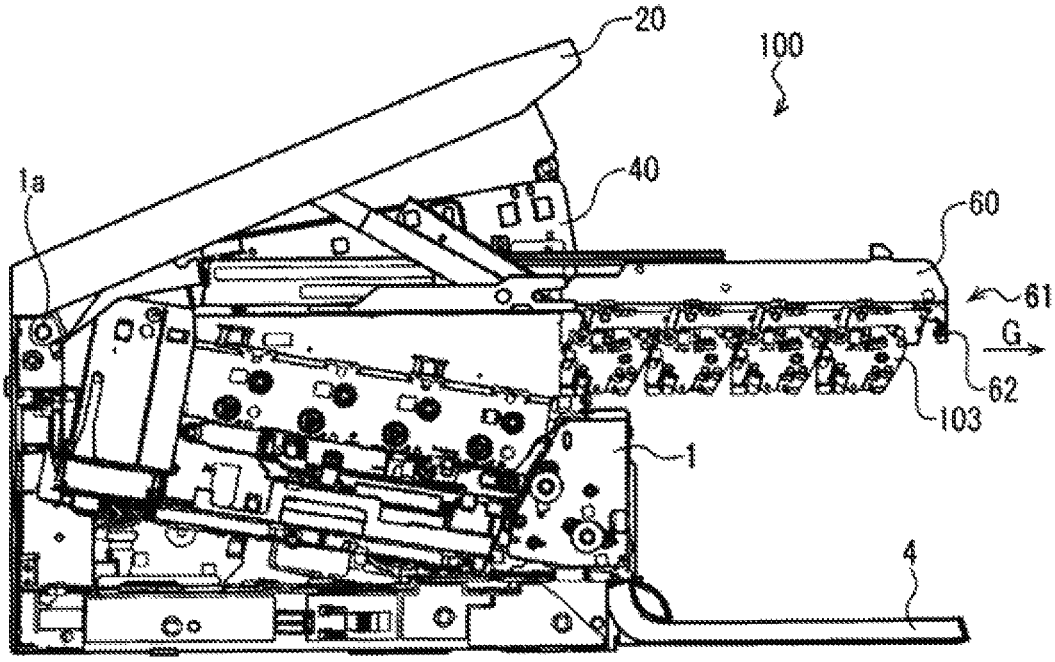
FIG. 18 is an explanatory diagram illustrating a pulled out state of the basket of the embodiment.

In the fourth state in which the guide rail 40 is regulated in rotation at a position where the basket 60 is substantially horizontal and is fixed with respect to apparatus main body 1, as illustrated in FIG. 18, by pulling the handle part 62 of the lock part 61 of the basket 60 in a forward direction of the apparatus main body 1 indicated by an arrow G in the drawing, the basket 60 which holds the ID units 103 slides relative to the guide rail 40 and moves out of the apparatus main body from the opening opened by the front cover 4.

Figure 19:
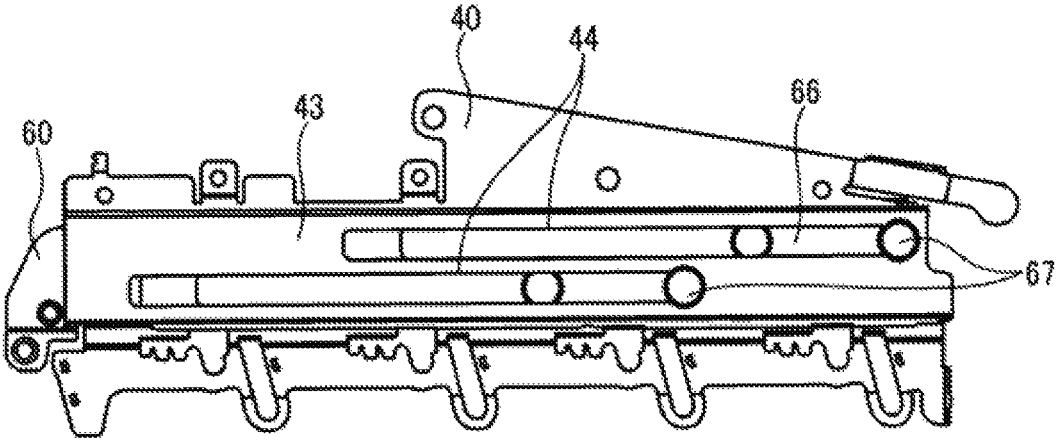
FIG. 19 is an explanatory diagram illustrating the basket and the guide rail of the embodiment.
Figure 20:
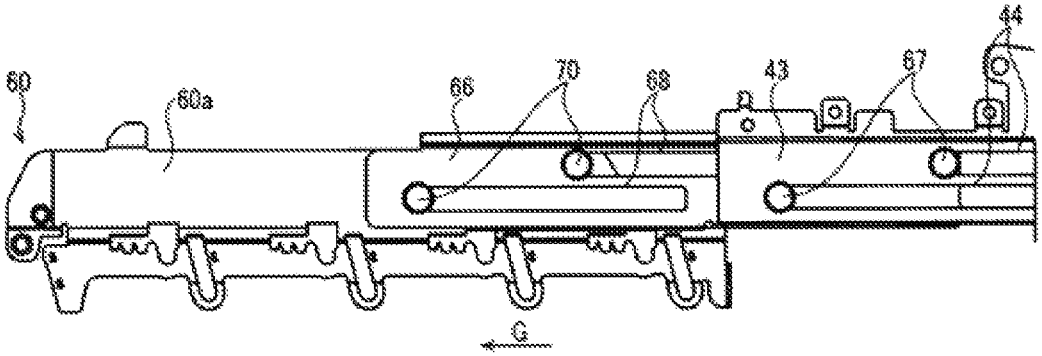
FIG. 20 is an explanatory diagram illustrating the basket and the guide rail of the embodiment.

In this case, in a state in which the basket 60 is not pulled out from the guide rail 40 as illustrated in FIG. 19, when the basket 60 is pulled out from the guide rail 40 as illustrated in FIG. 18, as illustrated in FIG. 20, the posts 67 of the rail plate 66 of the basket 60 which are engaged with the elongated holes 44 of the rail plate 43 of the guide rail 40 slide and become in contact with end parts of the elongated holes 44, and thus, further sliding of the rail plate 66 is regulated. In the embodiment, rail plate 43 and elongate holes 44 function to be a sliding regulating part that regulates sliding of the photosensitive unit holding member. Due to the sliding regulating part, the photosensitive unit is allowed to slide along the rail plate.

Further, when the basket 60 is pulled out from the guide rail 40, the posts 70 which are engaged with the elongated holes 68 of the basket 60 slide and become in contact with end parts of the elongated holes 68, and thus, further sliding of the basket 60 is regulated. In the embodiment, elongate holes 68 and posts 70 function to be a sliding part that slides in the forward direction until the posts contacts to the end parts of the elongated holes. In the embodiment, the pulling basket 60 out from guide rail 40 means that one of ID units 103, which is positioned the most distant from the front side of apparatus main body 1, comes to a position where the one of ID units 103 is closer to the front side than the tip of guide rail 40 in the horizontal direction (or medium carrying direction). FIG. 18 illustrates one example of the pulling out position.

In this way, when the engagement between the opening and closing cover 20 and the basket 60 is released by the lock part 30 and the engagement between the basket 60 and the apparatus main body 1 is released by the lock part 61, the guide rail 40 becomes rotatable relative to the opening and closing cover 20 which has been rotated, and is regulated in rotation by the support members 45 at a predetermined position where the basket 60 is slidable, and the basket 60 and the ID units 103 can be pulled out from the apparatus main body 1.

As a result, an operator can visually confirm the ID units 103 held by the basket 60 which has been moved out from the apparatus main body and can touch the ID units 103, and can easily perform a maintenance operation such as replacement of the ID units 103.

When returning from the fourth state to the third state, by pressing down the basket 60 and the guide rail 40 toward the apparatus main body 1, the posts 50 in contact with the wall parts 28*a* of the grooves 28 illustrated in FIG. 17 slide in a direction away from the grooves 28, press down the leaf springs 29 and move over the protruding parts 29*a*, and thus, the regulation of the rotation of the support members 45 is released.

In this way, in the present embodiment, when a jammed medium or the like is easily removed from the medium carrying path, by reaching the second state in which the opening and closing cover 20 and the basket 60 are engaged with each other by the lock part 30 and the engagement between the basket 60 and the apparatus main body 1 is released by the lock part 61, and the opening and closing cover 20 is rotated together with the guide rail 40 to separate the ID units 103 from the apparatus main body 1, an operator can touch the medium carrying path inside the image forming apparatus 100 from the opening 3 and the front side opening which have been opened without removing the ID units 103 from the image forming apparatus 100, and can easily remove a jammed medium or the like from the medium carrying path.

Further, when it is determined from a printing result that the LED heads 132 are dirty, by reaching the third state in which the engagement between the opening and closing cover 20 and the basket 60 is released by the lock part 30 and the basket 60 and the apparatus main body 1 are engaged with each other by the lock part 61 and only the opening and closing cover 20 is rotated to separate the LED heads 132 from the ID units 103, an operator can visually confirm the LED heads 132 attached to the opening and closing cover 20 which has been rotated and can touch the LED heads 132, and can easily clean the LED heads 132 by rotating the LED heads 132.

Further, when the ID units 103 are replaced due to a lifetime of the units 103 or the like, by reaching the fourth state in which the engagement between the opening and closing cover 20 and the basket 60 is released by the lock part 30 and the engagement between the basket 60 and the apparatus main body 1 is released by the lock part 61, and the guide rail 40 is rotated relative to the opening and closing cover 20 which has been rotated, and the rotation of the guide rail 40 is regulated by the support members 45 at a predetermined position where the basket 60 is slidable, an operator can visually confirm the ID units 103 held by the basket 60 moved out from the apparatus main body without removing the ID units 103 from the image forming apparatus 100, and can touch the ID units 103, and can easily perform a maintenance operation such as replacement of the ID units 103.

Further, it is not necessary to rotate the opening and closing cover 20 to a vertical position, and a maintenance operation can be performed from the front side of the image forming apparatus 100. Therefore, a space required to perform a maintenance operation of the image forming apparatus 100 can be reduced. In particular, a maintenance operation in a case where a rotation angle of the opening and closing cover 20 is limited due to presence of an obstacle above the image forming apparatus 100 can be smoothly performed.

As described above, in the present embodiment, an effect can be achieved that a maintenance operation of the image forming apparatus can be smoothly performed without removing the ID units from the image forming apparatus.

Further, an effect can be achieved that, when a jammed medium or the like is easily removed from the medium carrying path, the jammed medium or the like can be easily removed from the medium carrying path without removing the ID units from the image forming apparatus. Further, an effect can be achieved that, when it is determined from a printing result that the LED heads are dirty, the LED heads attached to the opening and closing cover which has been rotated can be easily cleaned.

Further, an effect can be achieved that, when the ID units are replaced due to a lifetime or the like of the ID units, a maintenance operation such as the replacement of the ID units can be easily performed without removing the ID units from the image forming apparatus. Further, an effect can be achieved that a space required to perform a maintenance operation of the image forming apparatus can be reduced. In particular, an effect can be achieved that a maintenance operation in a case where a rotation angle of the upper cover is limited due to presence of an obstacle above the image forming apparatus can be smoothly performed. In the present embodiment, the image forming apparatus is described as a color printer. However, the present invention is not limited to this. The image forming apparatus may also be a black and white printer, a copying machine, a facsimile machine, a multifunction machine (MFP), and the like.

What is claimed is:

1. An image forming apparatus provided with a photosensitive unit that has a photosensitive body and an exposure device that exposes the photosensitive body, comprising;

an apparatus main body that has an opening on its surface, having a rotation supporting point;

a first rotating member that holds the exposure device and is rotatably supported by the rotation supporting point of the apparatus main body such that the first rotating member opens or closes the opening of the apparatus main body by swinging around the rotation supporting point;

a second rotating member that is arranged between the apparatus main body and the first rotating member and is rotatably supported by the rotation supporting point of the apparatus main body;

a photosensitive unit holding member that holds the photosensitive unit and is slidably supported by the second rotating member;

a first engagement part that is provided in the first rotating member and engages with the photosensitive unit holding member; and a second engagement part that is provided in the photosensitive unit holding member and engages with the apparatus main body, wherein when the first rotating member and the photosensitive unit holding member are engaged with each other by the first engagement part, and engagement between the photosensitive unit holding member and the apparatus main body is released by the second engagement part, the first rotating member integrally rotates with the second rotating member to open the opening and to separate the photosensitive unit from the apparatus main body, and when engagement between the first rotating member and the photosensitive unit holding member is released by the first engagement part and the photosensitive unit holding member and the apparatus main body are engaged with each other by the second engagement part, the first rotating member rotates to separate the exposure device from the photosensitive unit.

2. The image forming apparatus according to claim 1, further comprising:

a rotation regulating part that regulates rotation of the second rotating member, wherein when the engagement between the first rotating member and the photosensitive unit holding member is released by the first engagement part and the engagement between the photosensitive unit holding member and the apparatus main body is released by the second engagement part, the second rotating member rotates between the first rotating member, which has been rotated, and the apparatus main body, and is regulated in its rotation by the rotation regulating part at a predetermined position where the photosensitive unit holding member is slidable.

3. The image forming apparatus according to claim 2, wherein the rotation regulating part has two ends in a longitudinal direction that are a free end and one end, which is opposite to the free end, the one end of the rotation regulating part is rotatably supported by the second rotating member, and, when the second rotating member is rotated to the predetermined position where the photosensitive unit holding member is slidable, the free end of the rotation regulating part engages with another engagement part of the apparatus main body to regulate the rotation of the second rotating member.

4. The image forming apparatus according to claim 3, wherein the rotation regulating part is in contact with the first rotating member and is regulated in rotation when the first rotating member and the photosensitive unit holding member are engaged with each other by the first engagement part, and the rotation regulating part is rotatable when the engagement between the first rotating member and the photosensitive unit holding member is released by the first engagement part and the first rotating member is rotated relative to the photosensitive unit holding member.

5. The image forming apparatus according to claim 2, further comprising:

one or more photosensitive units that are configured to be identical to the photosensitive unit, each of the photosensitive units containing different color developer from other photosensitive units, wherein the apparatus main body has a rotation shaft that rotates around the rotation supporting point and supports the first rotating member and the second rotating member, the rotation shaft extending in a rotation shaft direction, the photosensitive units are arranged in a medium carrying direction which is orthogonal to the rotation shaft direction and are arranged along a medium carrying path which inclines upward at a predetermined inclination angle as approaching the rotation shaft wherein a medium on which an image is formed is carried along the medium carrying path in the medium carrying direction, and when an angle by which the second rotating member has been rotated is substantially equal to the inclination angle of the medium carrying path, the second rotating member is regulated in its rotation by the rotation regulating part.

6. The image forming apparatus according to claim 2, wherein the apparatus main body further has another opening on it's a front surface on a front side wherein the another opening is a front opening, and has a front door that opens or close the front opening, in a state in which the rotation of the second rotating member is regulated by the rotation regulating part, when the photosensitive unit holding member is slid in a forward direction of the apparatus main body, the photosensitive unit moves out of the apparatus main body from the front opening opened by the front door.

7. The image forming apparatus according to claim 6, wherein the second rotating member has a sliding regulating part that regulates sliding of the photosensitive unit holding member, and the photosensitive unit holding member slides in the forward direction of the apparatus main body under regulation of the sliding regulating part.

8. The image forming apparatus according to claim 7, wherein the photosensitive unit holding member has a sliding part that slides in the forward direction of the apparatus main body, and the photosensitive unit moves out of the apparatus main body due to the sliding of the sliding part.

* * * * *